United States Patent [19]

Swenson

[11] Patent Number: 4,534,262

[45] Date of Patent: Aug. 13, 1985

[54] SAFETY MOORING LINE

[75] Inventor: Richard C. Swenson, Carriere, Miss.

[73] Assignee: The United States of America as represented by the Secretary of the Navy, Washington, D.C.

[21] Appl. No.: 481,522

[22] Filed: Apr. 1, 1983

[51] Int. Cl.[3] ..... D04C 1/12

[52] U.S. Cl. ..... 87/6; 57/210; 57/230; 87/2; 87/8

[58] Field of Search ..... 87/5-9, 87/2; 57/210, 225, 230, 231

[56] References Cited

U.S. PATENT DOCUMENTS

| | | | |
|---|---|---|---|
| 2,841,046 | 5/1957 | Runton | 87/2 |
| 3,030,851 | 2/1960 | Meyer | 87/6 |
| 3,968,725 | 12/1974 | Holzhauer | 87/6 |
| 4,059,847 | 9/1976 | Phillips et al. | 361/215 |
| 4,258,608 | 2/1979 | Brown | 87/6 |
| 4,312,260 | 9/1979 | Morieras | 87/1 |
| 4,321,854 | 3/1982 | Foote et al. | 87/6 |
| 4,412,474 | 11/1983 | Hara | 87/6 |

*Primary Examiner*—John Petrakes

*Attorney, Agent, or Firm*—Robert F. Beers; Francis I. Gray; Harvey A. David

[57] ABSTRACT

An improved safety mooring line of the type having an inner high stretch safety line and an outer high strength, low elongate synthetic fiber strength member also has an armor layer of a high strength, heat resistant synthetic fiber material braided over the safety line underneath the strength member. The armor layer is braided with a high braid angle so that it can elongate when the strength member parts, yet insulate the safety line from the heat and flailing ends of the strength member resulting from the released energy of parting.

4 Claims, 2 Drawing Figures

SAFETY MOORING LINE

BACKGROUND OF THE INVENTION

1. Field of the Invention

The present invention relates to nautical lines, and more particularly to an improved safety mooring line for securing a ship.

2. Description of the Prior Art

The marine community has replaced natural fiber mooring line such as manila rope with synthetic lines such as nylon, polyester and polyproplene. The synthetic lines have the major advantages of higher strength and greater rot resistance. However the higher elasticity together with poorer rendering properties on capstans and bitts create major hazards to personnel if the line jersk or parts. When the line parts, the ends snapback at the velocity of a bullet. In the U.S. Navy alone this has resulted in 380 mishaps, of which 278 resulted in major injuries with nine fatalities, reported for the period from 1970 through May 1982. Efforts have been attempted to make the use of synthetic lines safer, such as personnel training and attention to operating procedures, early rope retirement, attention to fittings, etc. Despite approximately 30 years of usage and accidents occurring on a global scale, no synthetic mooring line is available which is restrained from snapping back from its breaking point.

The most recent attempt to solve the snapback problem is described in co-pending patent application Ser. No. 244,463 filed on Mar. 16, 1981, by Richard C. Swenson entitled "A Safety Mooring Line". Here an inner, high stretch core serves as a safety line for a high strength, low stretch synthetic fiber line so that when the line breaks, the released ends are restrained by the still intact inner core. However for larger diameter, long lines sufficient heat is generated upon the release of energy when the line parts that the inner core melts, and additionally the core is lacerated by the flailing ends of the parted line resulting in inner core failure and total line snap back. Therefore, an improved safety line is desired which does not damage the inner core upon parting.

SUMMARY OF THE INVENTION

Accordingly, the present invention provides an improved safety mooring line of the type having an inner high stretch safety line and an outer high strength, low elongate synthetic fiber strength member. An armor layer of a high strength, heat resistant synthetic fiber material is braided over the safety line underneath the strength member. The armor layer is braided with a high braid angle so that it can elongated when the strength member parts, yet insulate the safety line from the heat and flailing ends of the strength member resulting from the released energy of parting.

Therefore, it is an object of the present invention to provide an improved safety mooring line which prevents snapback of larger diameter, long synthetic lines such as used as mooring lines for major ships.

Other objects, advantages and novel features of the present invention will be apparent from the following detailed description when read in conjunction with the appended claims and attached drawing.

DESCRIPTION OF THE PREFERRED EMBODIMENT

Figure 1:
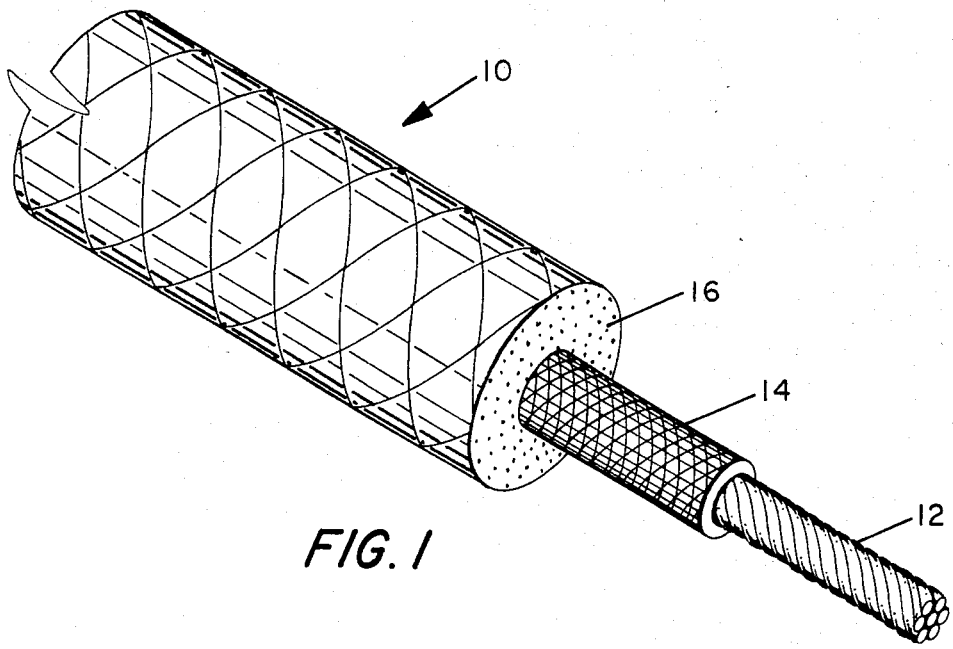
FIG. 1 is a perspective view of the end of an improved safety mooring line according to the present invention.

Referring to the FIG. 1 an improved safety mooring line 10 is shown. The line has inner core 12 of a material having a high stretch characteristic, such as nylon or the like. An armor layer 14 of a high strength, heat resistant synthetic fiber, such as "Kevlar", a proprietary aramid fiber of E. I. DuPont de Nemours, Corp., Wilmington, Del., or the like, is braided over the inner core 12 with a high braid angle. A strength member 16 having a high strength, low stretch characteristic is braided over the protective armor layer 14.

The strength member 16 is the load-bearing component, and is made of a synthetic fiber such as "Kevlar" or the like. The inner core 12, or safety line, serves to retain the ends of the line 10 when the strength member 16 parts under tension. The broken ends of the strength member 16 expand from load relaxation, releasing the core 12 along its entire length, and telescope or slide along the still intact armored safety line 12/14 in a controlled manner, piling up at its end point, thus preventing snapback and flailing in the vicinity of the line 10. The armor layer 14, due to the high braid angle, elongates with the inner core 12 when the strength member 16 parts, and acts to insulate the inner core from the generated heat and to protect the inner core from the flailing ends of the parted strength member. Due to the velocity of the recoil of the strength member 16 on parting, the armored safety line 12/14 serves as a guide for the recoiling ends and then stretches approximately five times the stretch of the strength member if the load is continued to be applied until it parts also. However, the stretching of the armored safety line 12/14 allows time for evacuation of personnel from the danger area, or for other corrective actions.

Figure 2:
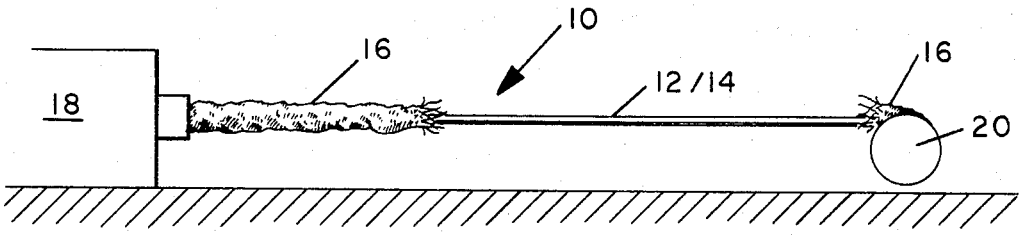
FIG. 2 is a representation of the reaction of the improved safety mooring line according to the present invention when it parts under load.

An example of such an improved safety mooring line 10 consists of seven strands of high twist nylon tire cord 12 over-braided with a thin layer of "Kevlar" protective jacket 14 applied at a high braid angle. This is followed by twelve strands of load-bearing "Kevlar" 16 applied in a twill braid to produce a line 1.5 inches in diameter with a 125,000 lb. breaking strength. Due to the high braid angle the core 12/14 stretches 25 percent to break the armor layer 14 and 45 percent to break the nylon safety line 12. The breaking strength of the core 12/14 is 10,000 lbs and occupies approximately 20 percent of the volume of the line 10. Repetitive failure tests of 180-foot lengths of this line resulted in no snapback upon parting of the strength member 16. As shown in FIG. 2 the center core 12/14 is intact, while the "Kevlar" strength member 16 recoils down the safety line, piling up at its end termination in a controlled fashion. The line 10 under test is attached with an eye end fitting at one end to a fixed reaction mass 18 and at the other end is wrapped several times around cylinder 20, representing a capstan. The cylinder 20 is supported by a caterpillar tractor (not shown) which provides the test pull.

Thus, the present invention provides an improved safety mooring line for large diameter, long lines having a heat resistant armor layer with a high braid angle over a high stretch safety line underneath a high strength, low stretch strength member to prevent melting and laceration of the safety line by the line ends when the strength member parts.

I claim:

1. A safety mooring line for reducing snapback hazard, said mooring line comprising:

a highly stretchable safety line formed of a high stretch material;

an armor layer formed of a heat resistant, low stretch and high strength synthetic fiber material, braided over said safety line with a high braid angle so as to be able to stretch and elongate with stretch of said safety line; and an outer strength member formed of a high strength, low stretch synthetic fiber braided over said armor layer and safety line so as to have a relatively low stretch characteristic and to be the load-bearing component of said mooring line;

said armor layer and said safety line being relatively unstretched whenever said strength member is under load and being readily stretched in the event of parting of said strength member so as to delay parting of said safety line and armor layer which guide recoil of the parted ends of said strength member telescopingly therealong, said armor layer being operative to protect said safety line from being broken as a result of heat and laceration by said parted ends as they recoil therealong, thereby preventing total snapback of said mooring line.

2. A safety mooring line as recited in claim 1 wherein said armor layer material is aramid fiber.

3. A safety mooring line as recited in claim 2 where said strength member material is aramid fiber.

4. A safety mooring line as recited in claim 3 wherein said safety line material is nylon.

* * * * *